US010022849B2

(12) United States Patent
Huang

(10) Patent No.: US 10,022,849 B2
(45) Date of Patent: Jul. 17, 2018

(54) NAIL GUIDING DEVICE FOR NAILER

(71) Applicant: Tsung-Wen Huang, Chang Hua County (TW)

(72) Inventor: Tsung-Wen Huang, Chang Hua County (TW)

( * ) Notice: Subject to any disclaimer, the term of this patent is extended or adjusted under 35 U.S.C. 154(b) by 381 days.

(21) Appl. No.: 15/014,092

(22) Filed: Feb. 3, 2016

(65) Prior Publication Data

US 2017/0217003 A1 Aug. 3, 2017

(51) Int. Cl.
*B25C 5/06* (2006.01)
*B25C 5/16* (2006.01)

(52) U.S. Cl.
CPC ..... *B25C 5/06* (2013.01); *B25C 5/1637* (2013.01)

(58) Field of Classification Search
CPC ..... B25C 5/06; B25C 5/1637
USPC ..... 227/119, 139
See application file for complete search history.

(56) References Cited

U.S. PATENT DOCUMENTS 4,770,335 A * 9/1988 Wingert ..... B25C 5/15 227/131
5,873,509 A * 2/1999 Liao ..... B25C 1/005 227/109
6,076,720 A * 6/2000 Deng ..... B25C 5/025 227/109
6,257,477 B1 * 7/2001 Strååt ..... B25C 5/0207 227/107
8,695,860 B2 * 4/2014 Wang ..... B25C 5/1665 227/109
9,221,163 B2 * 12/2015 Wang ..... B25C 5/06

* cited by examiner

*Primary Examiner* — Michelle Lopez
(74) *Attorney, Agent, or Firm* — Bacon & Thomas, PLLC

(57) ABSTRACT

A nail guiding device of a nailer includes a guiding portion for guiding the nails along a straight path. The nailer has a reception recess with which a guiding member is pivotably connected. A guiding plate includes two grooves defined along two sides thereof. The strike plate and nails are slidably moved along the guiding plate between the two grooves. The guiding plate has first and second slots. The guiding member has a pivot pivotably inserted in the reception recess, a first guiding portion, a first rail, a second rail parallel to the first rail and a second guiding portion. The guiding member has a resilient arm connected thereto which contacts an inside of the body of the nailer. The first and second rails swing through the first and second slots so as to guide the nails to be ejected along a straight path.

8 Claims, 9 Drawing Sheets

NAIL GUIDING DEVICE FOR NAILER

BACKGROUND OF THE INVENTION

1. Fields of the Invention

The present invention relates to a nailer, and more particularly, to a nail guiding device of a nailer to ensure that the nails are ejected along a straight path.

2. Descriptions of Related Art

The conventional nailers use a strike plate to strike the nails out from the nailer. In order to ensure that the nails are ejected along a straight path, a nail guiding device is provided such as the nail guiding device disclosed in U.S. Pat. No. 5,692,665 which includes a pivot to be pivotably connected between two guide rods, and a resilient plate is used to pivot the two guide rods forward so as to guide the nails to be ejected along a straight path. However, the nail guiding device includes too many parts, and the guide rods are narrow and slim so that the two guide rods are easily shifted or swung during the movement of the striking plate. This may not properly guide the nailers.

Another conventional nail guiding device is disclosed in FIG. 9 and includes a guide board 60, at least one guiding member 70 and a resilient member 80, wherein the guide board 60 is located at the front of the nail track and has at least one straight and upright slot 61. The guiding member 70 movably extends through the slot 61 and has a support protrusion 71. The resilient member 80 is mounted to the support protrusion 71 so as to bias the guiding member 70 beyond the slot 61 to guide the nails 90.

When a wide nail 90 contacts the guide board 60, the two legs of the nail 90 contact the inside of the slot 61 and the nail 90 compresses the guiding member 70 so that the resilient member 80 is retracted into the slot 61. Before the strike plate 62 hits the nail 90, the nail 90 resiliently compresses the guiding member 70 for a long period of time, so that the resilient member 80 tends to reach its fatigue point quickly and the nails 90 may not be ejected as desired.

The support protrusion 71 has multiple bosses and notches such that the resilient member 80 can move smoothly. The multiple bosses and notches increase the manufacturing cost and time.

When assembling, there are multiple resilient members 80 which are small and easily drop off. Each resilient member 80 has to be maintained the same biasing force to make sure that the guiding member 70 is not tilt, so that the assembling takes a lot of time.

The present invention intends to provide a nail guiding device of a nailer and improves the shortcomings mentioned above.

SUMMARY OF THE INVENTION

The present invention relates to a nail guiding device of a nailer, and comprises a body having an outlet portion defined in one end thereof. An end plate is located at one side of the outlet portion and a reception recess is defined in the body. A guiding portion is located within the body and before the end plate. The guiding portion has a guiding plate fixed to the body. The guiding plate has a first face and a second face.

Two grooves are respectively defined in two sides of the first face.

A strike plate and nails are guided to be moved along the first face between the two grooves. A first slot and a second slot are defined through the guiding plate and located between the two grooves. A guiding member is located to face the second face of the guiding plate, and has a pivot which is pivotably inserted into the reception recess, a neck extending from the pivot and connected to a first rail, and a second rail located at a distance from the first rail. The second rail is parallel to the first rail. The first and second rails are respectively inserted into the first and second slots. A positioning portion is defined beneath the neck.

An arm unit is connected to the positioning portion of the guiding member and made of elastic material. The arm unit has a first end thereof connected to the positioning portion, and a second end of the arm unit is a resilient arm which is located between the guiding member and the end plate of the outlet portion. The second end of the resilient arm contacts the end plate. The first and second rails swing through the first and second slots such that the nails are ejected in a straight path.

The nail guiding device of a nailer of the present invention has advantages which are that the guiding member is connected with a resilient arm made of elastic material so that the guiding member swings about the pivot to guide or contact the nails without using a spring.

The guiding member includes a neck, first and second rails and first and second guiding portions. The guiding rails have different length and are parallel to each other. The guiding member is durable for prolonging the life of use of the nailer.

The guiding rails swing through the first and second slots and are lowed lower than the transverse portion of the nails so that the legs of the nails contact one of the grooves and the first rail, or the first and second rails, or one of the grooves and the second rail. The first and second rails are supported by the resilient arm to protrude through the first and second slots.

After the nail is ejected, the resilient arm is released and the first and second rails return back to the first and second slots.

When in action, the first and second rails swing through the first and second slots. One end of the resilient arm is restricted by the positioning portion so that the guiding member does not shake during action to avoid the resilient arm from being deformed.

The resilient arm is an elongate arm and made of elastic material and which has one end connected to the positioning portion of the guiding member such that the resilient arm is well positioned. The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
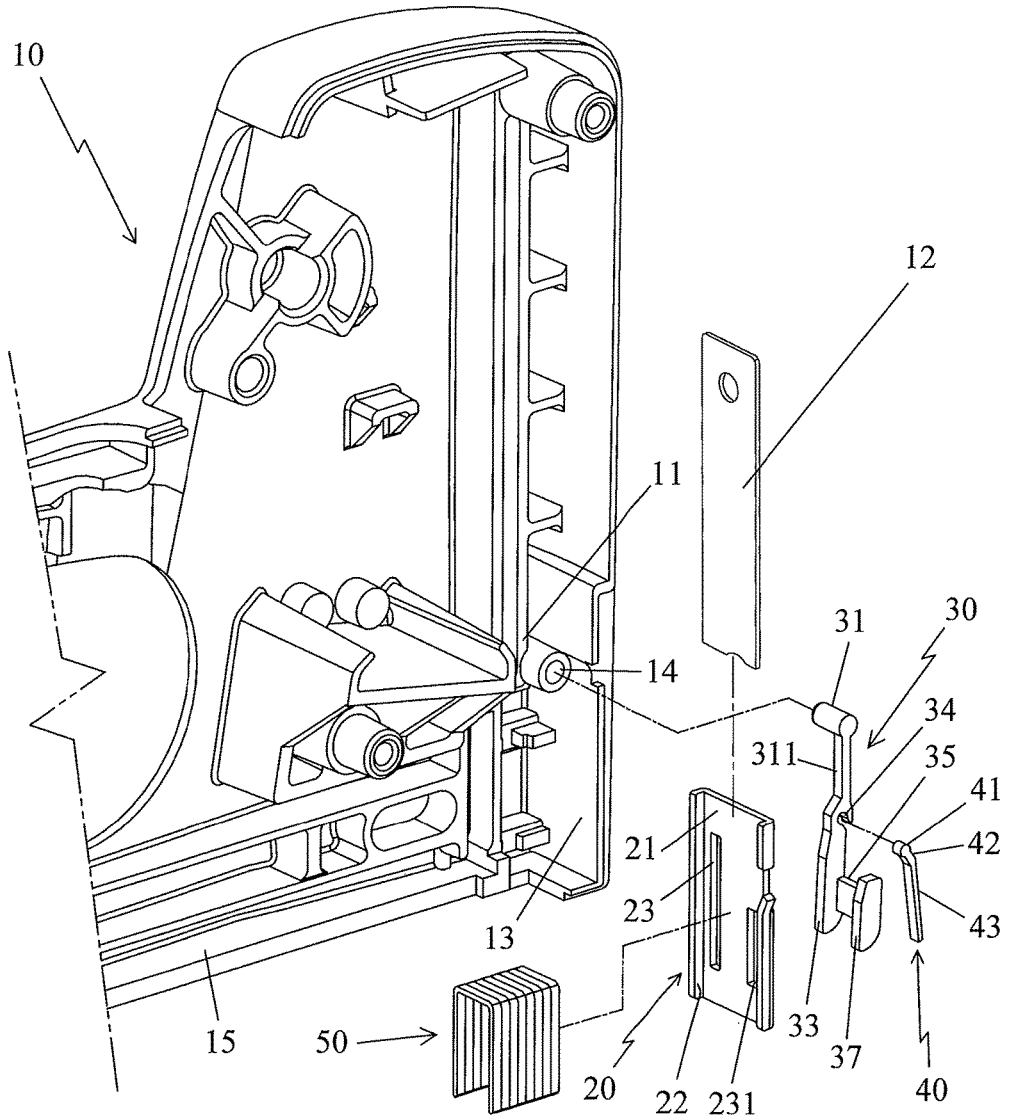
FIG. 1 is an exploded view of the nail guiding device of the present invention.
Figure 2:
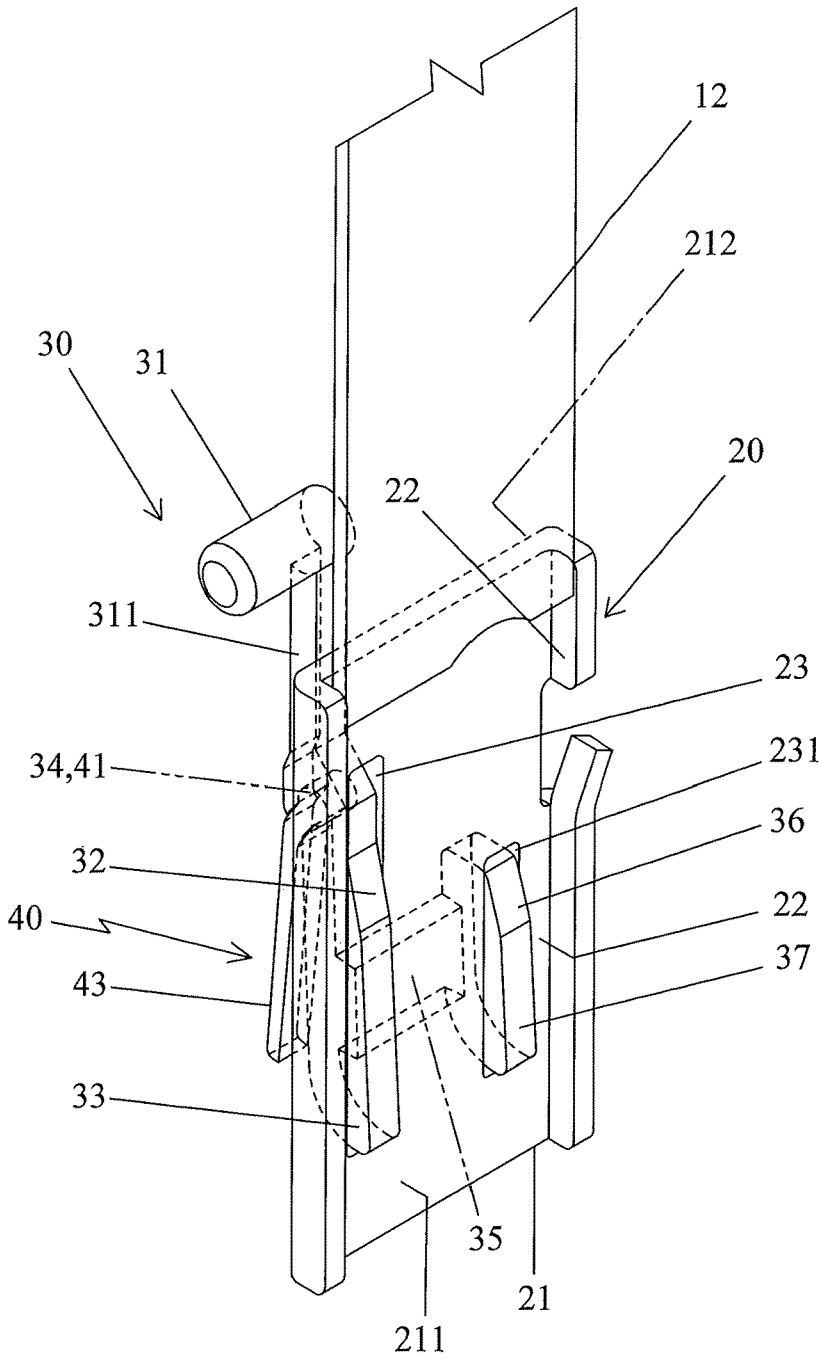
FIG. 2 is a perspective view to show the nail guiding device of the present invention.
Figure 3:
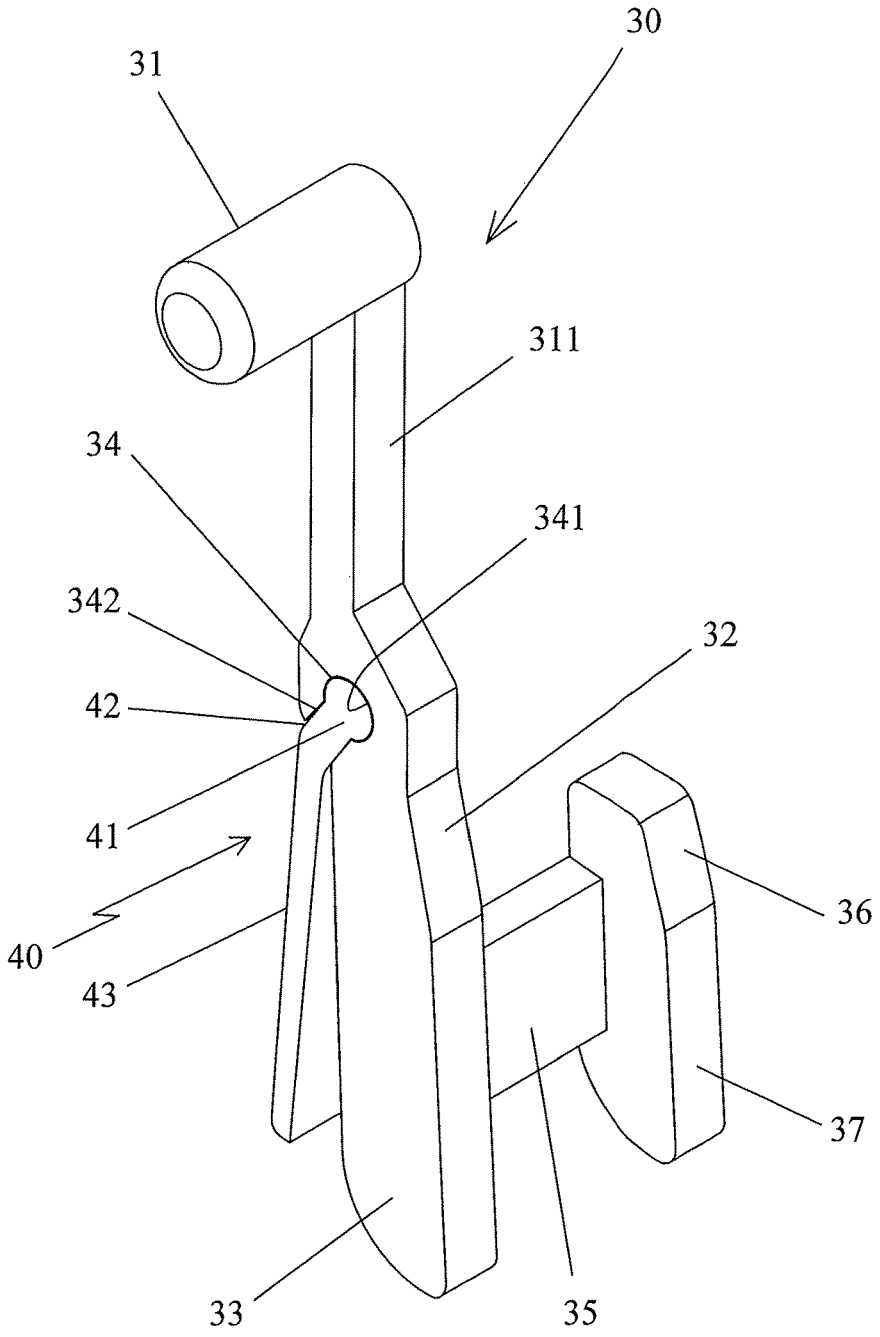
FIG. 3 is a perspective view to show the guiding member of the nail guiding device of the present invention.

Referring to FIGS. 1 to 3, the nail guiding device of the present invention comprises a body 10 having an outlet portion 11 defined in one end thereof, and an end plate 13 is located at one side of the outlet portion 11. A reception recess 14 is defined in the body 10 and located at the lateral side of the outlet portion 11.

A guiding portion 20 is located within the body 10 and before the end plate 13. The guiding portion 20 has a guiding plate 21 fixed to the body 10, and the guiding plate 21 having a first face 211 and a second face 212. Two side flanges respectively extend from two sides of the first face 211 so as to define two grooves 22 the two sides of the first face 211. A strike plate 12 and nails 50 are guided to be moved along the guiding plate 21 and within the two grooves 22. A first slot 23 and a second slot 231 are defined through the guiding plate 21 and located between the two grooves 22. Specifically, the first and second slots 23, 231 are defined axially in the guiding plate 21. The first and second slots 23, 231 are parallel to each other. The first slot 23 is longer than the second slot 231.

A guiding member 30 is located to face the second face 212 of the guiding plate 21. The guiding member 30 has a pivot 31 which is pivotably inserted into the reception recess 14. A neck 311 extends from the pivot 31 and is connected to a first rail 33, and a second rail 37 is located at a distance from the first rail 33. A connection section 35 is connected between the first and second rails 33, 37. The second rail 37 is parallel to the first rail 33. Each the first and second rails 33, 37 has a flat face that faces the guiding plate 21. A first guiding portion 32 is located above the first rail 33, and a second guiding portion 36 is located above the second rail 37. Each of the first and second guiding portions 32, 36 is an inclined face. The first and second rails 33, 37 are respectively inserted into the first and second slots 23, 231. A positioning portion 34 is defined beneath the neck 311.

An arm unit 40 is connected to the positioning portion 34 of the guiding member 30 and made of elastic material. The arm unit 40 has a first end thereof connected to the positioning portion 34, and a second end of the arm unit 40 includes a resilient arm 43 which is located between the guiding member 30 and the end plate 13 of the outlet portion 11. The resilient arm 32 is located at a gap from the first rail 33 so as to have a bouncing force when the resilient arm 43 is pushed toward the first rail 33. The resilient arm 43 has a head 41 at the first end thereof and the second end of the resilient arm 43 contacts the end plate 13. The first and second rails 33, 37 swing through the first and second slots 23, 231. The first rail 33 is longer than the second rail 37, and the first and second slots 23, 231 each have the length suitable for the first and second rails 33, 37 swinging through the first and second slots 23, 231. The positioning portion 34 of the guiding member 30 has a hole 341 and an engaging slot 342 which extends from the hole 341 and communicates with the hole 341 as shown in FIG. 3. The head 41 of the resilient arm 43 is shaped to have a flat extension 42 which is engaged with the engaging slot 342 and does not rotate within the engaging slot 342.

When the guiding member 30 is pivotably connected to the reception recess 14 of the body 10, the first and second rails 33, 37 extend through the first and second slots 23, 231, and the distal end of each of the first and second rails 33, 37 does not protrude beyond the height of two flanges of the guiding plate 21.

Figure 4:
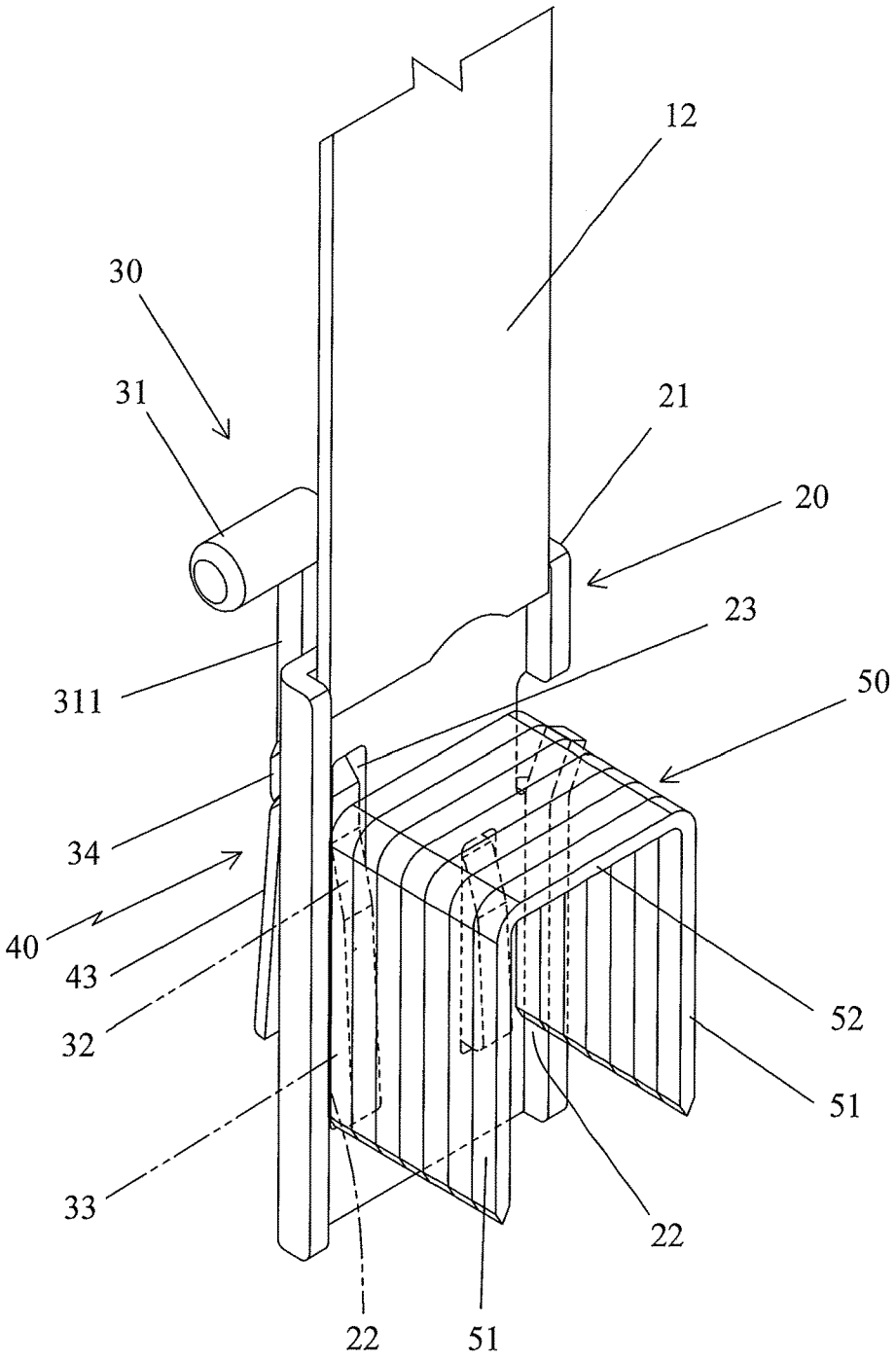
FIGS. 4 and 5 show the nails of two different sizes are cooperated with the nail guiding device of the present invention.

The present invention can be cooperated with different nails of different shapes and widths. As shown in FIG. 4, the wide inverted U-shaped nails 50 are installed in the receiving space 15 of the nailer. The nails 50 are biased toward the guiding plate 21 by a spring which is not shown. The two legs of the first one of the nails 50 are engaged with the grooves 22, and the transverse portion 52 of the nail 50 contacts the first face of the guiding plate 21. The first and second rails 33, 37 are located between the two legs 51 and do not interfere the nails 50.

Figure 6:
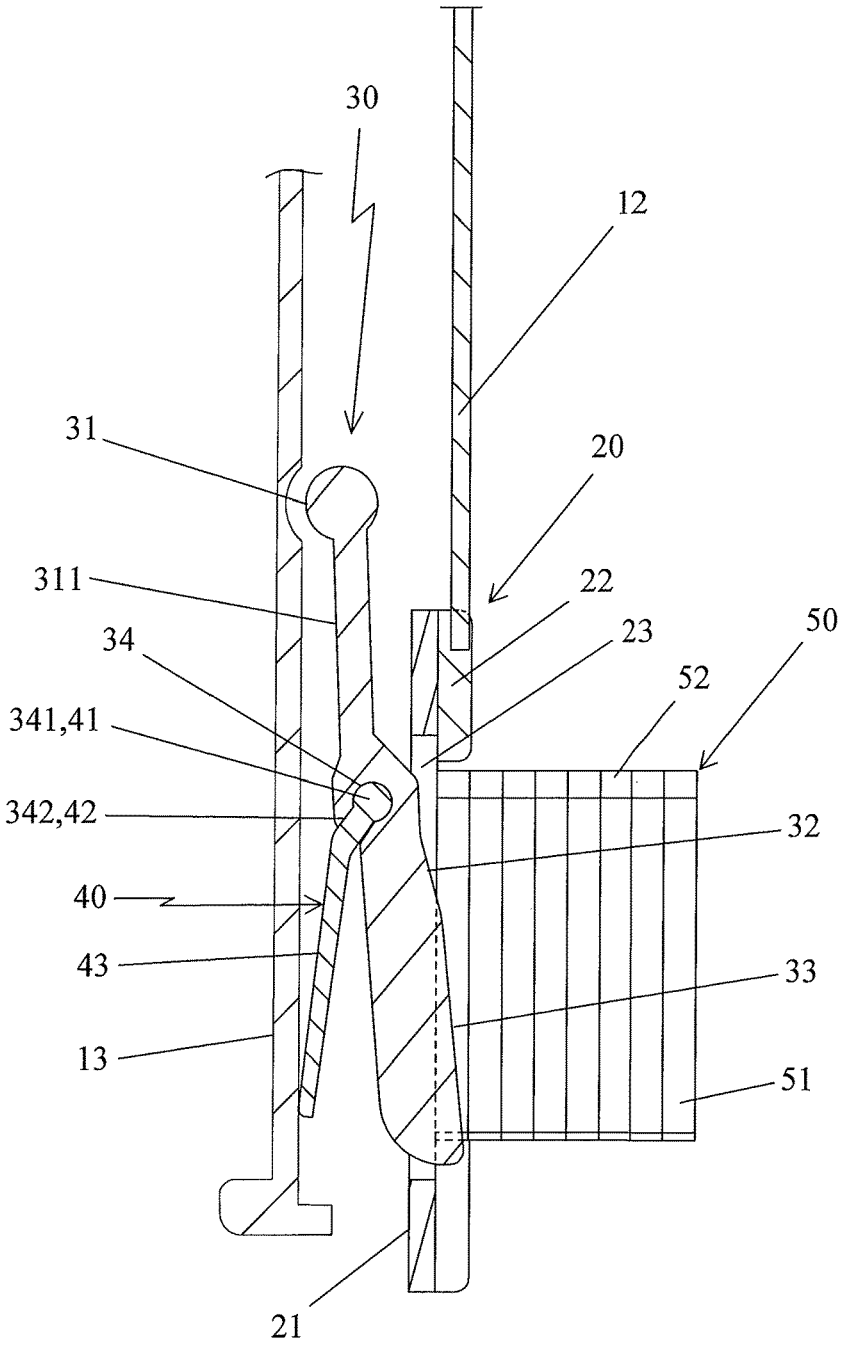
FIGS. 6 and 7 are side views to show the nails are ejected by the strike plate.
Figure 7:
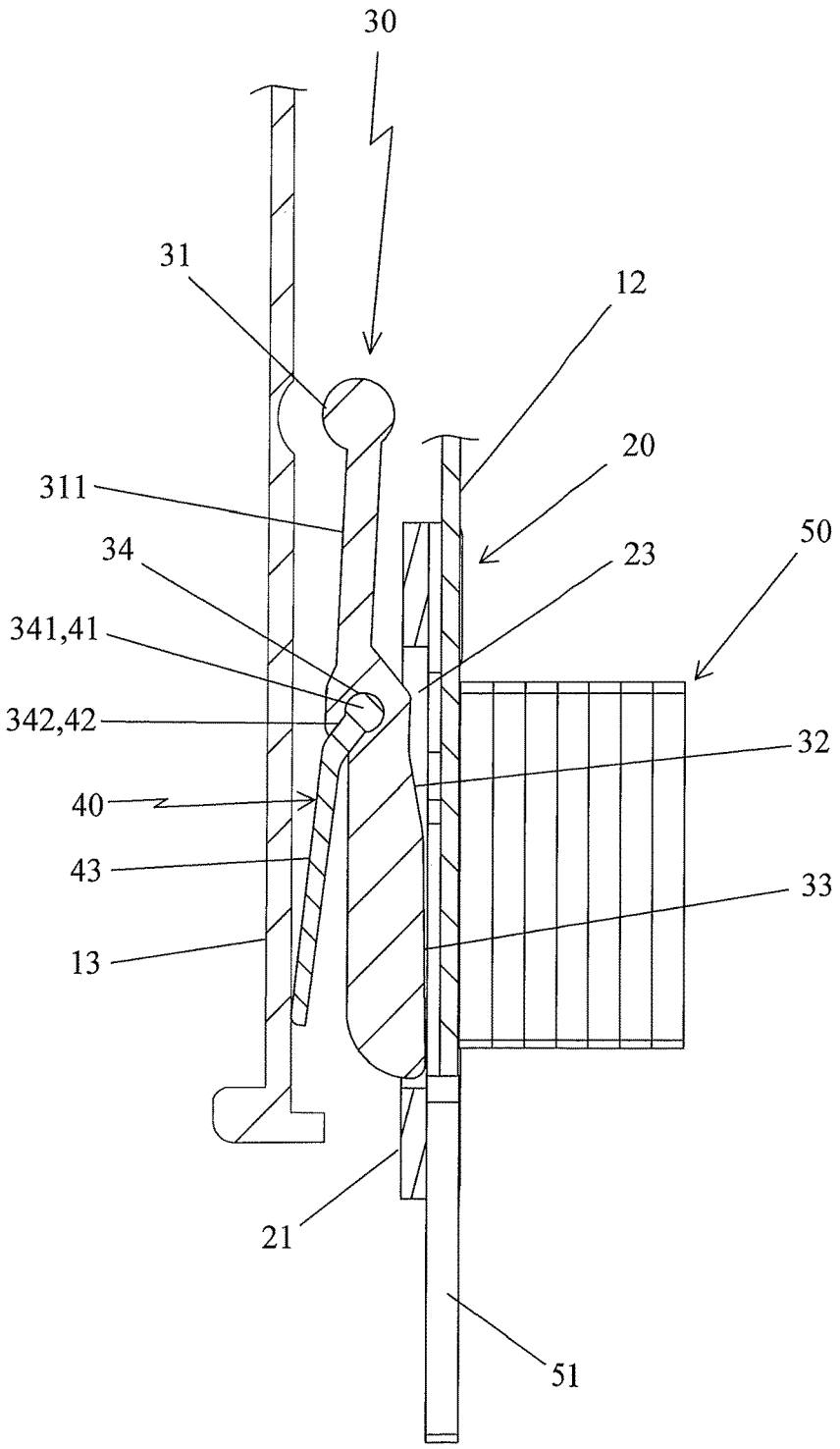

When the user activates the nailer, as shown in FIGS. 4, 6 and 7, the strike plate 12 moves downward along the two flanges of the guiding plate 21 and hits the transverse portion 52 of the nail 50, the two legs 51 move along the flanges, the transverse portion 52 of the nail 50 contacts the first and second guiding portions 32, 36 to push the first and second rails 33, 37 to be retracted into the first and second slots 23, 231. Because the head 41 and the extension 42 are connected to the guiding member 30, the resilient arm 43 is deformed by the reaction from the end plate 13. The gap between the resilient arm 43 and the first rail 33 is reduced. The nail 50 is ejected by the strike plate 12 in a straight path. After ejection, the deformed resilient arm 43 bounces back to swing the first and second rails 33, 37 back through the first and second slots 23, 231.

Figure 5:
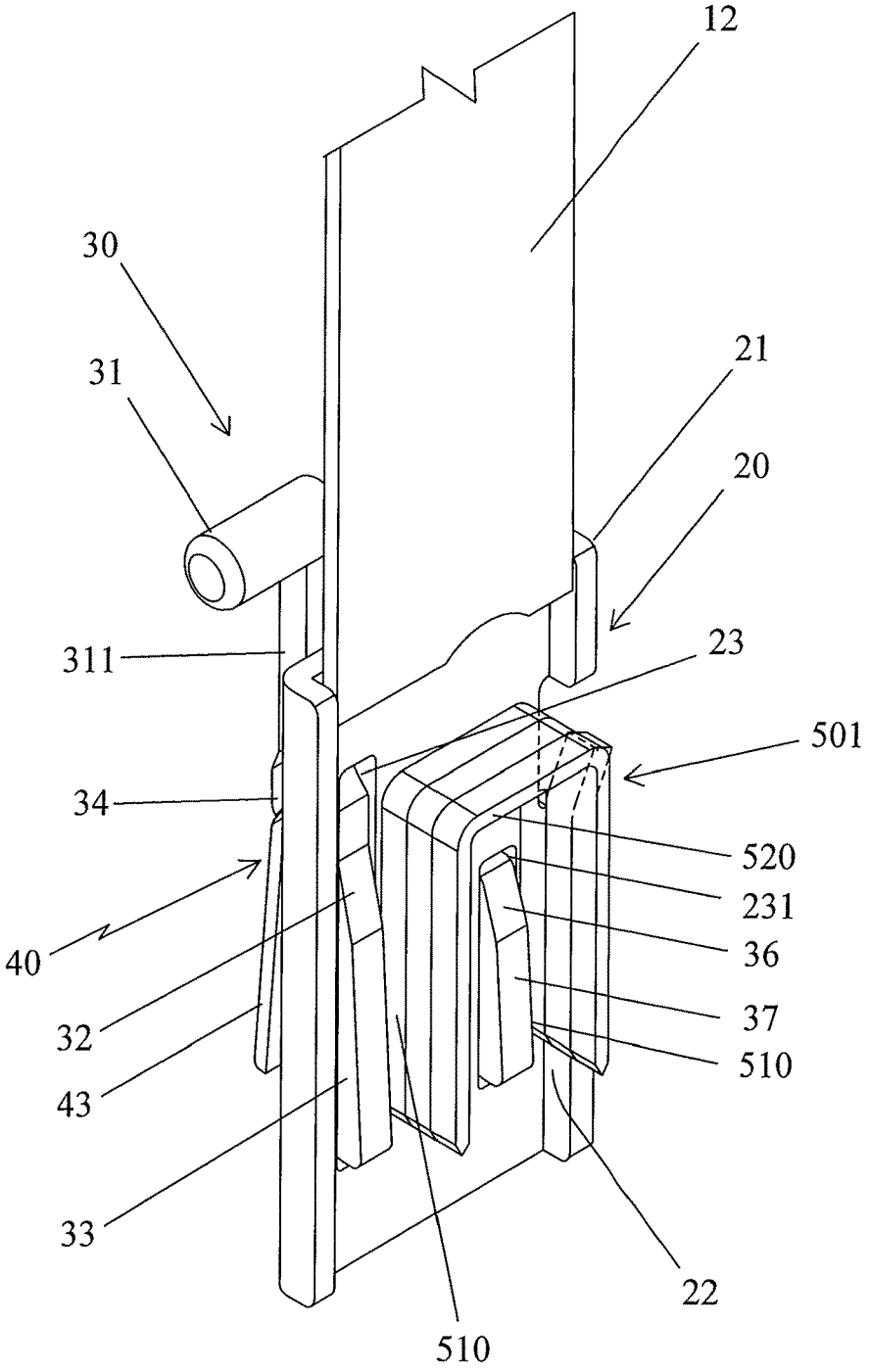

As shown in FIG. 5, when narrower inverted U-shaped nails 501 are used, the nails 501 are pushed to contact the first face 211 of the guiding plate 21, and the two legs 510 respectively located in one of the two grooves 22 and the first rail 37, and the other leg 510 contacts the first rail 33. Therefore, the two legs 510 are well positioned and can be ejected along a straight path.

Figure 8:
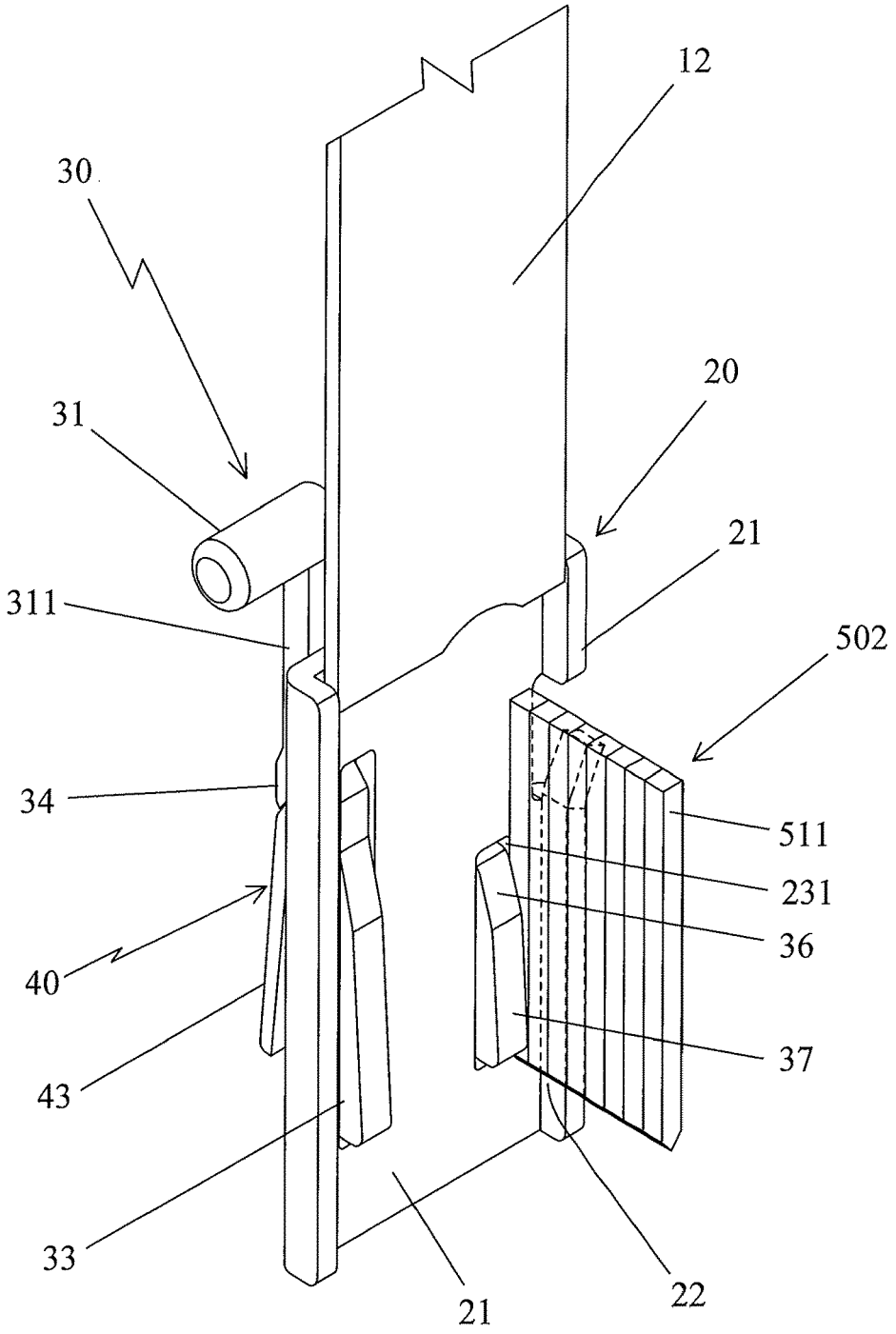
FIG. 8 shows yet another nails are used with the nail guiding device of the present invention.
Figure 9:
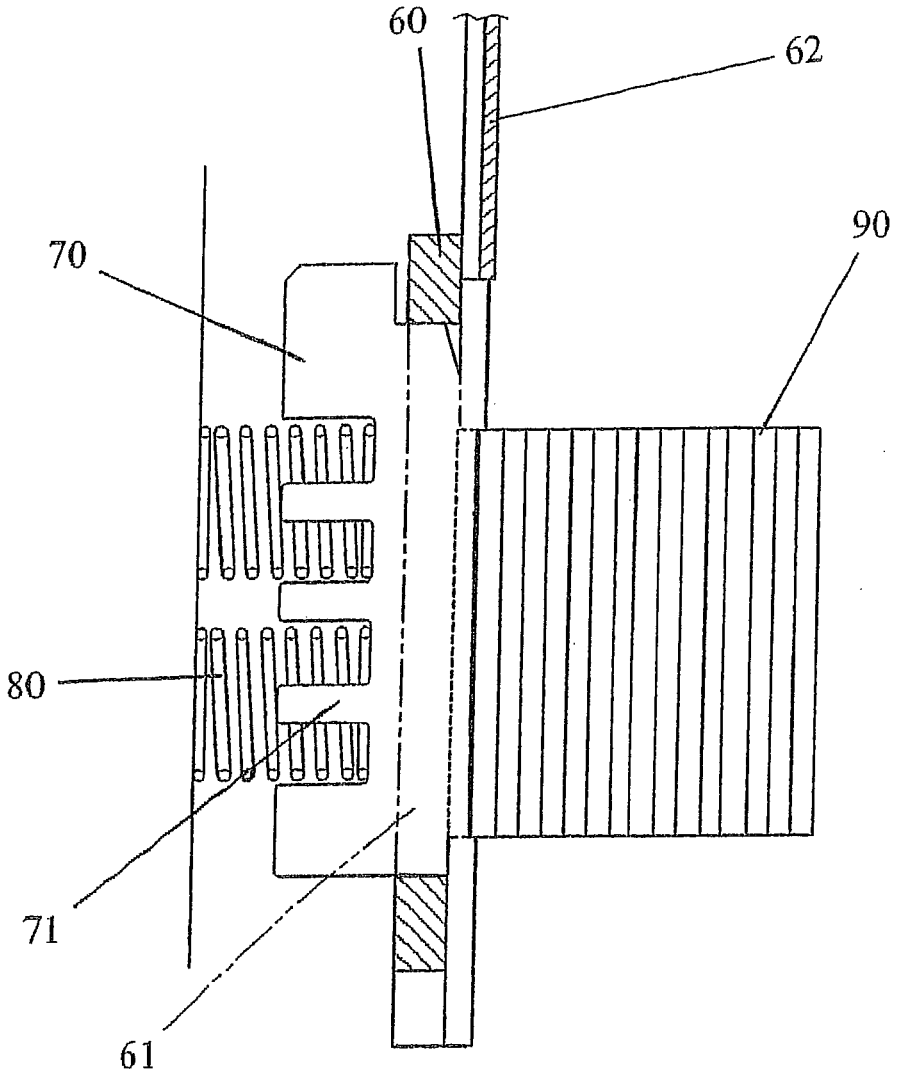
FIG. 9 PRIOR ART
FIG. 9 shows the conventional the nail guiding device.

As shown in FIG. 8, the nails can be I-shaped nails 502, the nails 502 contact the guiding plate 21, and the single leg 511 is restricted between one of the flanges and the second rail 37. The nails 502 can also be ejected along a straight path.

While we have shown and described the embodiment in accordance with the present invention, it should be clear to those skilled in the art that further embodiments may be made without departing from the scope of the present invention.

What is claimed is:

1. A nail guiding device of a nailer, comprising:

a body having an outlet portion defined in one end thereof, an end plate located at one side of the outlet portion, a reception recess defined in the body;

a guiding portion located within the body and before the end plate, the guiding portion having a guiding plate fixed to the body, the guiding plate having a first face and a second face, two grooves respectively defined in two sides of the first face, a strike plate and nails being guided to be moved within the two grooves, a first slot and a second slot defined through the guiding plate and located between the two grooves;

a guiding member being located to face the second face of the guiding plate, the guiding member having a pivot which is pivotably inserted into the reception recess, a neck extending from the pivot and connected to a first rail, and a second rail located at a distance from the first rail, the second rail being parallel to the first rail, the first and second rails respectively inserted into the first and second slots, a positioning portion defined beneath the neck, and an arm unit connected to the positioning portion of the guiding member and made of elastic material, the arm unit having a first end thereof connected to the positioning portion, a second end of the arm unit having a resilient arm which is located between the guiding member and the end plate of the outlet portion, the resilient arm is located at a gap from the first rail and contacting the end plate, the first and second rails swinging through the first and second slots such that the nails are ejected in a straight path.

2. The nail guiding device of a nailer as claimed in claim 1, wherein the reception recess is defined in a lateral side of the outlet portion.

3. The nail guiding device of a nailer as claimed in claim 1, wherein the first and second slots are defined axially in the guiding plate, the first and second slots are parallel to each other.

4. The nail guiding device of a nailer as claimed in claim 1, wherein the first rail is longer than the second rail, the first and second slots each have a length suitable for the first and second rails swinging through the first and second slots.

5. The nail guiding device of a nailer as claimed in claim 1, wherein a connection section is connected between the first and second rails.

6. The nail guiding device of a nailer as claimed in claim 1, wherein the positioning portion of the guiding member has a hole and an engaging slot which extends from the hole and communicates with the hole, the resilient arm has a head at the first end thereof and the head is shaped to have a flat extension which is engaged with the engaging slot and does not rotate within the engaging slot.

7. The nail guiding device of a nailer as claimed in claim 1, wherein the guiding member has a first guiding portion and a second guiding portion located above the first and second rails respectively, each of the first and second guiding portions is an inclined face.

8. The nail guiding device of a nailer as claimed in claim 1, wherein each the first and second rails has a flat face that faces the guiding plate.

* * * * *